US012366127B2

(12) United States Patent
Wern et al.

(10) Patent No.: US 12,366,127 B2
(45) **Date of Patent: *Jul. 22, 2025**

(54) ELECTRIC TONG WITH ONBOARD HYDRAULIC POWER UNIT

(71) Applicant: Weatherford Technology Holdings, LLC, Houston, TX (US)

(72) Inventors: Frank Wern, Hannover (DE); Bjoern Thiemann, Burgwedel (DE); Thomas Kotschy, Burgdorf (DE); Michael Wiedecke, Salzhemmendorf (DE)

(73) Assignee: Weatherford Technology Holdings, LLC, Houston, TX (US)

( * ) Notice: Subject to any disclaimer, the term of this patent is extended or adjusted under 35 U.S.C. 154(b) by 1010 days.

This patent is subject to a terminal disclaimer.

(21) Appl. No.: 17/034,958

(22) Filed: Sep. 28, 2020

(65) Prior Publication Data

US 2021/0010336 A1 Jan. 14, 2021

Related U.S. Application Data

(63) Continuation of application No. 15/675,404, filed on Aug. 11, 2017, now Pat. No. 10,787,869.

(51) Int. Cl.
*E21B 19/16* (2006.01)

(52) U.S. Cl.
CPC ..... *E21B 19/164* (2013.01); *E21B 19/163* (2013.01)

(58) Field of Classification Search
CPC ..... E21B 19/164; E21B 19/163
(Continued)

(56) References Cited

U.S. PATENT DOCUMENTS 3,722,329 A 3/1973 Van Hecke et al.
4,210,017 A 7/1980 Motsinger
(Continued)

FOREIGN PATENT DOCUMENTS

AU 2014215938 A1 9/2014
EP 1961912 A1 8/2008
EP 1961913 A1 8/2008

OTHER PUBLICATIONS

Hawe Hydraulic SE Brochure, Hydraulic power packs type MP, D 7200 H, Nov. 2014, 9 pages.
(Continued)

*Primary Examiner* — Hadi Shakeri
(74) *Attorney, Agent, or Firm* — Smith IP Services, P.C.

(57) ABSTRACT

A method and apparatus for local hydraulic power generation on an electric tong, including a power tong for spinning tubulars; a first electric motor functionally connected to the power tong; a plurality of hydraulic power consumers including a backup tong for clamping a tubular string; a second electric motor functionally connected to the plurality of hydraulic power consumers; electronics to drive the first electric motor and the second electric motor; and a switchbox providing at least two configurations of the system. A method includes arranging a tong system in a hydraulic power configuration; supplying hydraulic power with an onboard electric motor to at least one of a plurality of hydraulic power consumers to position a tubular for make-up; arranging the tong system in a rotary drive configuration; supplying at least one of torque and rotation with the onboard electric motor to a power tong.

13 Claims, 6 Drawing Sheets

(58) Field of Classification Search
USPC ..... 81/57.14
See application file for complete search history.

(56) References Cited

U.S. PATENT DOCUMENTS

| | | | | |
|---|---|---|---|---|
| 4,515,045 | A | 3/1985 | Gnatchenko et al. | |
| 5,167,173 | A | 12/1992 | Pietras | |
| 5,385,514 | A | 1/1995 | Dawe | |
| 6,082,225 | A | 7/2000 | Richardson | |
| 6,748,823 | B2 | 6/2004 | Pietras | |
| 6,776,070 | B1 | 8/2004 | Mason et al. | |
| 6,925,807 | B2 | 8/2005 | Jones et al. | |
| 7,231,969 | B2 | 6/2007 | Folk et al. | |
| 7,281,451 | B2 | 10/2007 | Schulze Beckinghausen | |
| 7,854,265 | B2 | 12/2010 | Zimmerman | |
| 7,874,352 | B2 | 1/2011 | Odell, II et al. | |
| 7,882,902 | B2 | 2/2011 | Boutwell, Jr. | |
| 8,051,745 | B2 | 11/2011 | Petrak | |
| 8,109,179 | B2 | 2/2012 | Richardson | |
| 8,141,642 | B2 | 3/2012 | Olstad et al. | |
| 8,210,268 | B2 | 7/2012 | Heidecke et al. | |
| 8,291,791 | B2 * | 10/2012 | Light | E21B 19/164 81/57.16 |
| 8,636,067 | B2 | 1/2014 | Robichaux et al. | |
| 8,668,003 | B2 | 3/2014 | Osmundsen et al. | |
| 8,875,365 | B2 | 11/2014 | Huseman et al. | |
| 9,366,097 | B2 | 6/2016 | Hu et al. | |
| 9,376,875 | B2 * | 6/2016 | Reitsma | E21B 21/08 |
| 9,404,322 | B2 | 8/2016 | Wiedecke et al. | |
| 9,453,377 | B2 | 9/2016 | Mosing et al. | |
| 9,528,332 | B2 | 12/2016 | Richardson | |
| 9,657,539 | B2 | 5/2017 | Gupta et al. | |
| 9,879,700 | B1 | 1/2018 | Jackowski et al. | |
| 2004/0069497 | A1 | 4/2004 | Jones et al. | |
| 2005/0269072 | A1 | 12/2005 | Folk et al. | |
| 2007/0074606 | A1 | 4/2007 | Halse | |
| 2009/0321086 | A1 | 12/2009 | Zimmermann | |
| 2010/0200222 | A1 | 8/2010 | Robichaux et al. | |
| 2013/0055858 | A1 | 3/2013 | Richardson | |
| 2013/0075106 | A1 | 3/2013 | Tran et al. | |
| 2013/0269926 | A1 | 10/2013 | Liess et al. | |
| 2014/0131052 | A1 | 5/2014 | Richardson | |
| 2014/0305662 | A1 | 10/2014 | Giroux et al. | |
| 2015/0053424 | A1 | 2/2015 | Wiens et al. | |
| 2015/0101826 | A1 | 4/2015 | Gupta et al. | |
| 2015/0107385 | A1 | 4/2015 | Mullins et al. | |
| 2015/0107850 | A1 | 4/2015 | Mosing et al. | |
| 2015/0143960 | A1 | 5/2015 | Hu et al. | |
| 2015/0337648 | A1 | 11/2015 | Zippel et al. | |
| 2016/0097246 | A1 | 4/2016 | Youngquist, Jr. et al. | |
| 2018/0142535 | A1 | 5/2018 | Sitka et al. | |
| 2019/0048671 | A1 | 2/2019 | Wern et al. | |

OTHER PUBLICATIONS

Hawe Hydraulic SE Brochure, Hydraulic power packs type MPN and MPNW, D 7207, Mar. 5, 2008, 30 pages.

Fundamentals of Hydraulic Motors, Staff Report, Hydraulics and Pneumatics, Jun. 26, 2014, http://hydraulicspneumatics.com/hydraulic-pumps-motors/fundamentals-hydraulic-motors, accessed Aug. 12, 2015 (6 total pages).

Warrior, 500E Electric Top Drive (500 ton-1000hp), Brochure, Document No. EC 009, May 2015, Rev. 3, www.warriorrig.com.

United Kingdom Combined Search and Examination Report dated Jan. 30, 2019 for Application No. GB1812957.7.

United Kingdom Office Action dated Feb. 28, 2020 for Application No. GB1812957.7.

Compact Dynamics GMBH Brochure, Dynax 60i, www.compact-dynamics.de, 2 pages.

Compact Dynamics GMBH Brochure, Dynax MGi25-48, www.compact-dynamics.de, 2 pages.

Hawe Hydraulic SE Brochure, Hydraulic power type MP, D 7200 H, Nov. 2014, 9 pages.

Hawe Hydraulic SE Brochure, Hydraulic power type MPN and MPNW, D 7207, Mar. 5, 2008, 30 pages.

Frank's International Brochure, 7 5/8 Inch Electric Tong, Copyright 2016, 1 page.

A123 Systems, 14Ah Prismatic Pouch Cell, Product Specification, www.a123systems.com.

Eaton Low Speed High Torque Motors E-MOLO-MC001-E6 Brochure, Sep. 2011 (16 total pages).

Fundamentals of Hydraulic Motors, Staff Report, Hydraulics and Pneumatics, Jun. 26, 2014, http://hydralicspneumatics.com/hydraulic-pumps-motors/fundamentals-hydraulic-motors, accessed Aug. 12, 2015 (6 total pages).

Offshore Magazine, "Field-tested power tong handles all sizes of casing, drillpipe, tubing," Apr. 1, 2008, http://www.offshoremag.com/articles/2008/04/fieldtestedpowertonghandlesallsizesofcasingdrillpipetubing.html, accessed Apr. 12, 2017 (2 pages).

Warrior, 250E Electric Top Drive (250-Ton), 250H Hydraulic Top Drive (250-Ton), Brochure, Apr. 2014, Rev. 1, www.warriorrig.com.

Warrior, 250E Electric Top Drive (500 ton-1000hp), Brochure, Document No. EC 009, May 2015, Rev. 3, www.warriorrig.com.

Weatherford, TorkSub Stand-Alone Torque Measuring System, Product Specification, Document No. 11368.00, Copyright 2011-2014, www.weatherford.com.

Weatherford, TorkPro 3 and JAMPro Net Systems Speed Decision Making, Improve Casing Run Rate by 300%, Brochure, Document No. 11713.00, Copyright 2015, www.weatherford.com.

* cited by examiner

ELECTRIC TONG WITH ONBOARD HYDRAULIC POWER UNIT

CROSS-REFERENCE TO RELATED APPLICATIONS

This application is a Continuation of application Ser. No. 15/675,404 filed on Aug. 11, 2017, which application is incorporated herein by reference in its entirety.

BACKGROUND OF THE INVENTION

Field of the Invention

Embodiments of the present invention generally relate to systems and methods for local hydraulic power generation on an electric tong.

Description of the Related Art

Tongs are devices used on oil and gas rigs for gripping, clamping, spinning, and/or rotating tubular members, such as casing, drill pipe, drill collars, and coiled tubing (herein referred to collectively as tubulars and/or tubular strings). Tongs may be used to make-up or break-out threaded joints between tubulars. Tongs typically resemble large wrenches, and may sometime be referred to as power tongs, torque wrenches, spinning wrenches, and/or iron roughnecks. Tongs have typically used hydraulic power to provide sufficiently high torque to make-up or break-out threaded joints between tubulars. Such hydraulic tongs have suffered from the requirement of a hydraulic power generator on the rig floor, necessitating big hydraulic hoses connecting the hydraulic power generator to the tong, causing contamination concerns and excessive noise. Moreover, due to the distance from the power generator to the tong, hydraulic tongs have suffered from reliability issues and imprecise control of the torque.

Electric tongs have been proposed. For example, U.S. Pat. No. 9,453,377 suggests retrofitting a conventional hydraulic power tong with an electric motor. The electric motor would then be used to operate the power tong for rotating or spinning a tubular during make-up or break-out operations. A separate electric motor is proposed to actuate lift cylinders between the power tong and the backup tong. Another separate electric motor is proposed for applying clamping force to the backup tong. However, electric power supply for a tong might be insufficient when extreme forces are required. Moreover, the multiplicity of electric motors may be impractical when costs are an issue.

Local hydraulic power generation on an electric tong may provide improved handling, greater reliability, and increased safety and efficiency at reasonable costs.

SUMMARY OF THE INVENTION

The present invention generally relates to systems and methods for local hydraulic power generation on an electric tong.

In an embodiment a tong system includes a power tong for spinning tubulars; a first electric motor functionally connected to the power tong; a plurality of hydraulic power consumers including a backup tong for clamping a tubular string; a second electric motor functionally connected to the plurality of hydraulic power consumers; and electronics to drive the first electric motor and the second electric motor.

In an embodiment, a tong system includes a power tong for spinning tubulars; a plurality of hydraulic power consumers including a backup tong for clamping a tubular string; an onboard electric motor; and a switchbox providing at least two configurations of the tong system: in a first configuration, the onboard electric motor drives the power tong but does not supply hydraulic power to the plurality of hydraulic power consumers; and in a second configuration, the onboard electric motor does not drive the power tong but does supply hydraulic power to at least one of the plurality of hydraulic power consumers.

In an embodiment, a tong system includes a backup tong for clamping a tubular string; an onboard electric motor; and an onboard hydraulic power unit coupled to the onboard electric motor to supply hydraulic power to the backup tong.

In an embodiment, a method of making-up tubulars includes arranging a tong system in a hydraulic power configuration; supplying hydraulic power to at least one of a plurality of hydraulic power consumers to position a tubular for make-up; arranging the tong system in a rotary drive configuration; supplying at least one of torque and rotation to a power tong; wherein an onboard electric motor of the tong system supplies the hydraulic power when the tong system is in the hydraulic power configuration, and the onboard electric motor supplies the at least one of torque and rotation when the tong system is in the rotary drive configuration.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally relate to systems and methods for local hydraulic power generation on an electric tong.

In some embodiments, onboard electric motors may be beneficially utilized to supply large power densities that are controllable with a variable frequency drive. For example, the speed and/or torque of an electric motor may be controlled to reach a predefined target torque and/or to keep a predefined torque profile. The torque of the electric motor may be proportional to the current that is regulated electronically by a variable frequency drive, while the speed may be in phase with the generated frequency. In one embodiment, miniaturized, controllable electric motors may be mounted on the tong system (i.e., "onboard"). In some embodiments, the onboard electric motors may be capable of producing output in the range of about 2 kW/kg to about 5 kW/kg. In some embodiments, the onboard electric motors may be between about 8 kg and about 12 kg, for example, about 10 kg. In some embodiments, the onboard electric motor may be coupled to one or more of a reducing gear, another gear stage for low gear, and a flameproof housing. In some embodiments, these combined components may be between about 64 kg and about 96 kg, which may still be lighter than similar power provide by a hydraulic system.

Figure 1:
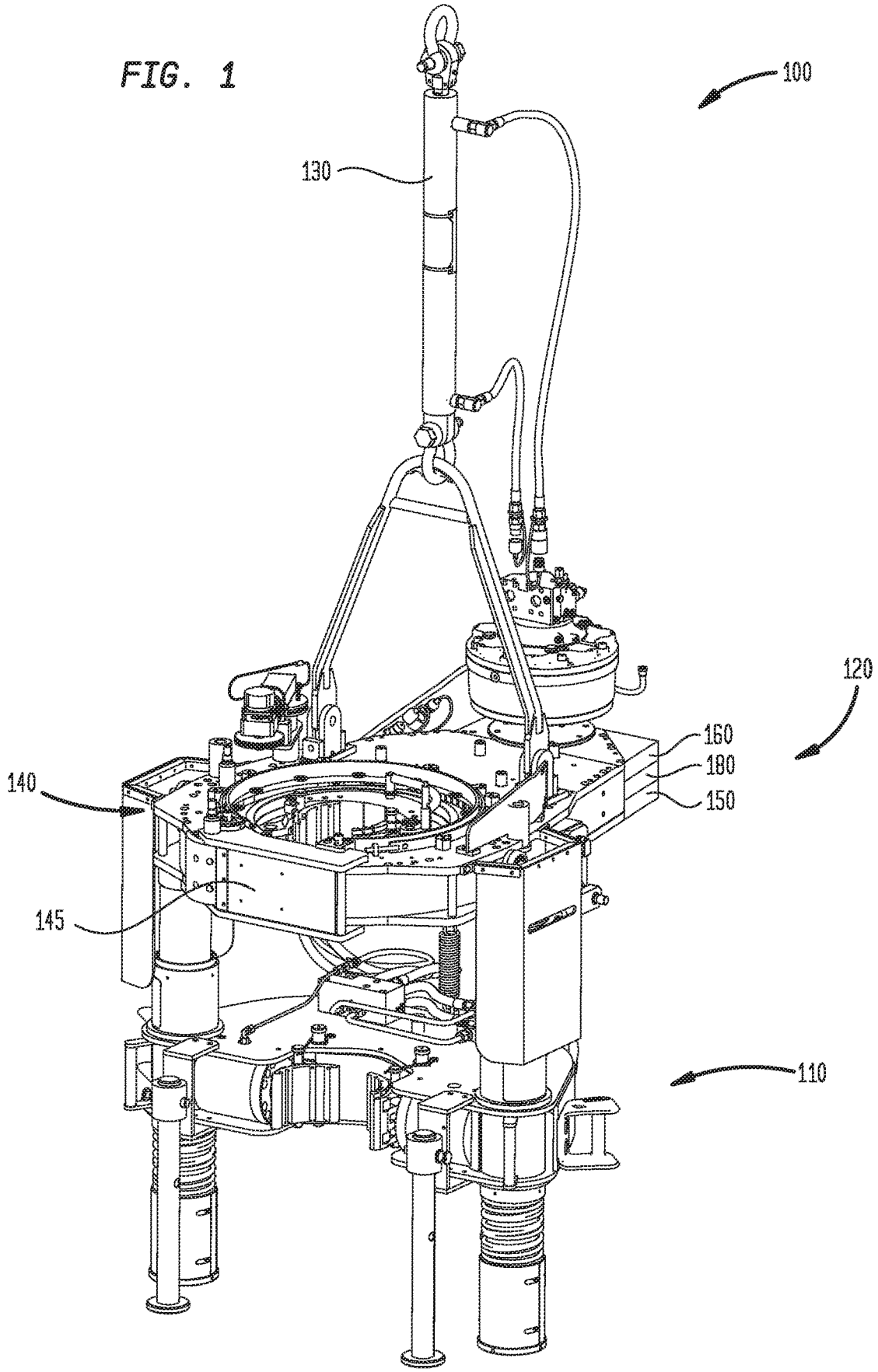
FIG. 1 illustrates a tong system with local hydraulic power generation.

As illustrated in FIG. 1, a tong system 100 suitable for use on oil and gas rigs generally includes a backup tong 110 for gripping and/or clamping the tubular string and a power tong 120 for spinning the tubular. The backup tong 110 may generally be below the power tong 120. The backup tong 110 clamps the tubular string to provide an opposing force to the torque applied to the tubular from power tong 120. Consequently, the backup tong 110 may be characterized as generally having high torque at low rpm requirements. The power tong 120 spins the tubular during make-up/break-out operations. Consequently, the power tong 120 may be characterized as generally having high torque at high rpm requirements. The tong system 100 may also include one or more lift actuators 130 (e.g., a linear actuator cylinder) for vertically positioning the backup tong 110. The tong system 100 may also include one or more door actuators 140 for controlling the tubular access door 145. In embodiments discussed below, tong system 100 also includes one or more of a hydraulic power unit 150, power electronics 160, and/or a switchbox 180, to provide local hydraulic power generation.

Figure 2:
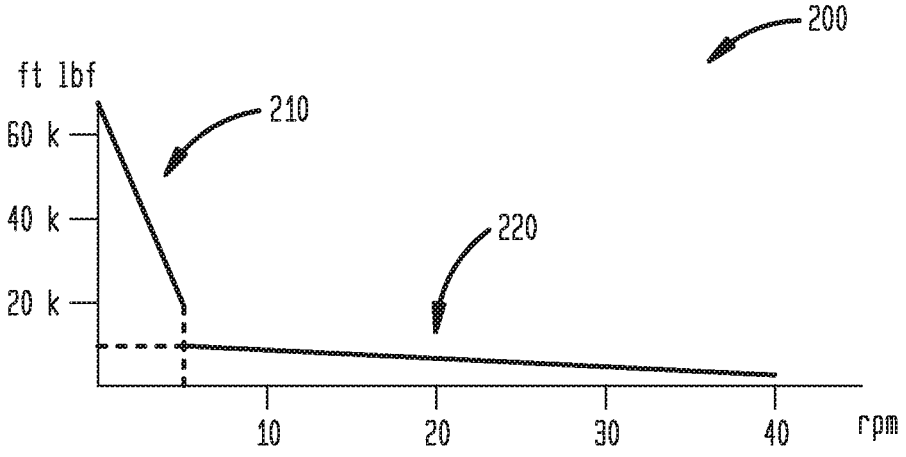
FIG. 2 illustrates a graph of maximum torque values vs. rotation speed for a power tong in low gear and in high gear.

In some embodiments, the average power required to operate a power tong 120 during one work cycle may be less than 10% of the maximum power. For example, FIG. 2 illustrates a graph 200 of the maximum torque values vs. rotation speed for a 50 k ft lbf power tong 120 in low gear and in high gear. It should be appreciated that the power of the tong may be limited by the available power of the hydraulic supply and by physical layout. In the example of FIG. 2, the rated pressure (that results in the maximum torque) may be about 200 bar, and the maximum volume flow rate the tong may accept may be about 100 liter/minute. Therefore, the maximum power that the system may be capable of would be about 33.33 kW. As illustrated in FIG. 2, the power tong 120 may operate in low gear at region 210, generating torque of between about 20 k ft lbf and about 60 k ft lbf. With the power tong 120 in low gear, the tubular rotates at up to about 5 rpm. Therefore, the maximum power requirement in low gear is about:

$$20\text{ k ft lbf}*0.305\text{ m/ft}*4.448\text{ N/lbf}*5\text{ rpm}*2*\pi/60 \quad s=14.2\text{ kW} \tag{1}$$

The power tong 120 may operate in high gear at region 220, generating torque of between about 4 k ft lbf and about 10 k ft lbf. Therefore, the maximum power requirement in high gear is about:

$$3\text{ k ft lbf}*0.305\text{ m/ft}*4.448\text{ N/lbf}*40\text{ rpm}*2*\pi/60 \quad s=17.0\text{ kW} \tag{2}$$

Likewise, when operating in the high gear region 220, the power tong 120 may provide higher torque at lower rpm with similar maximum power requirements:

$$12\text{ k ft lbf}*0.305\text{ m/ft}*4.448\text{ N/lbf}*10\text{ rpm}*2*\pi/60 \quad s=17.0\text{ kW} \tag{3}$$

The examples from Equations 1-3 are upper values which are normally only demanded for a short period of time. During an entire make-up cycle of about 120 seconds, the average power is about 10% of the maximum power requirement. Therefore, with the maximum power required in low gear region 210 or in high gear region 220 being approximately 14.2 kW and 17.0 kW respectively, the average power required in either of these regions is 1.4 kW and 1.7 kW, respectively, which is less than about 10% of the maximum power of the system (33.33 kW), and a local battery may be capable of supplying the power for the power tong 120 without significantly increasing safety concerns (e.g., risks of excessive heat in the explosive atmosphere of an oil rig). For example, peak power may be supplied to power tong 120 by a lithium titanate or lithium iron phosphate battery. Such a battery may supply about 1.2 kW/kg to about 2.4 kW/kg without excessive heating.

Figure 3:
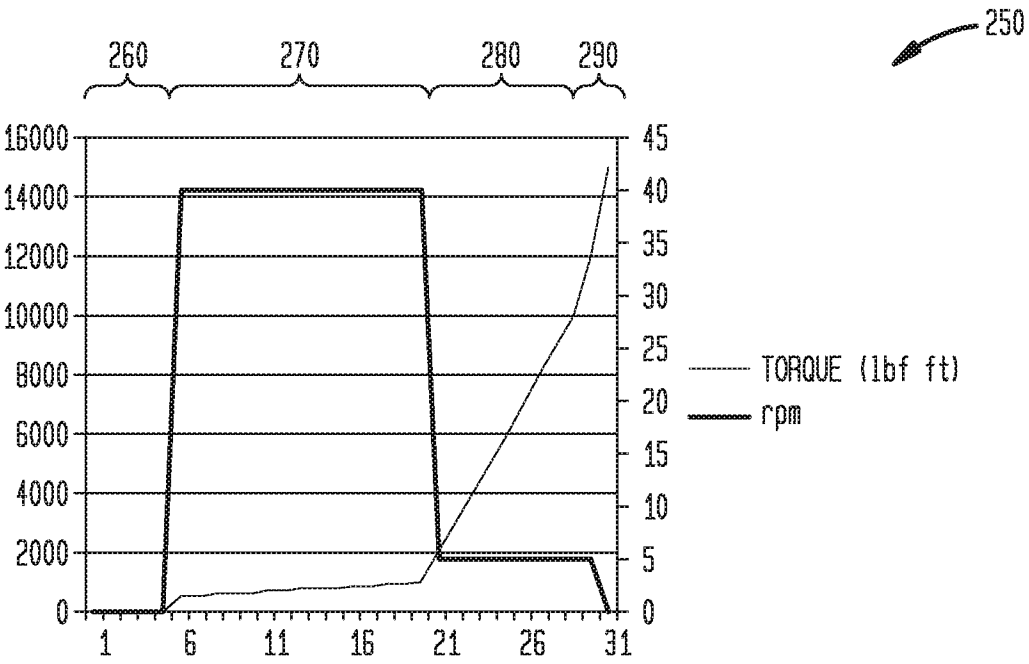
FIG. 3 illustrates a graph of torque and rotation speed required over a typical work make-up cycle for a power tong.

FIG. 3 illustrates a graph 250 of the torque and rotation speed required over a typical make-up cycle for a power tong 120. At the beginning of the make-up cycle, in region 260 (e.g., about first 5 seconds), the rotor may be slowly rotated in low gear to engage the tubular threads and confirm that the threading has engaged correctly. During the middle of the make-up cycle, in region 270, the rotor (now in high gear) speeds-up to the maximum speed (for example, as defined for this tubular type by the drilling contractor). The high rpm may be maintained for about 15 seconds until a reference torque is reached. For example, the reference torque may be selected to stop the tong well before the tubular shoulders engage. When the reference shoulder torque is reached, the power tong 120 is switched back to low gear. In region 280, the make-up may be done smoothly and/or continuously in low gear (e.g. for about the next 8 seconds). Lastly, the threads are secured in region 290 as indicated by rapidly increasing torque and decreasing rpm. The required power, which is the product of torque and turns, is normally less than half of the maximum power. Furthermore, the complete work cycle is more than 2 minutes, because bringing in another pipe, stabbing- in, and finally lowering the string into the well takes most of the time. Considering this, the average power is about 10% of the maximum power of the tong.

Electric power supply for a tong might be insufficient when extreme forces are required. Moreover, the multiplicity of electric motors may be impractical when costs are an issue. Therefore, a source of local hydraulic power is proposed. As illustrated in FIG. 1, tong system 100 includes local hydraulic power generation. As previously discussed, the tong system 100 includes a backup tong 110, a power tong 120, and one or more lift actuators 130. Tong system 100 also includes a hydraulic power unit 150. In some embodiments, hydraulic power for the backup tong 110 may be supplied by the hydraulic power unit 150. For example, the backup tong 110 may utilize high force to clamp cylinders to clamp the tubular string and thereby counterbalance the high torque of the power tong 120. In some embodiments, hydraulic power for the lift actuators 130 may be supplied by the hydraulic power unit 150. For example, the lift actuators 130 may utilize high force to vertically position (e.g., raise or lower) the backup tong 110 while it clamps the tubular string. In some embodiments, the volume of the hydraulic power unit 150 may be less than (e.g., about 10% of) that of conventional hydraulic power units which had been located proximate the rig floor. For example, a rig floor hydraulic power unit that is capable of producing up to about 35 kW-about 40 kW may have a volume of about 400 liters, while hydraulic power unit 150 may have a volume of between about 30 liters and about 40 liters, or in some embodiments less than about 50 liters. Hydraulic power unit 150 may include a tank with a submerged motor and a dual stage pump. Hydraulic power unit 150 may include a tank with a submerged motor and a pump with a booster. Hydraulic power unit 150 may include a tank with a submerged motor with a variable frequency drive. Hydraulic power unit 150 may include a tank with a submerged small motor with a hydraulic accumulator. In some embodiments, the hydraulic power unit 150 may supply power so that the cylinders (e.g., clamp cylinders of backup tong 110, lift cylinders of lift actuators 130) have fast action while having maximum pressure. Exemplary hydraulic power units 150 may include compact hydraulic power packs wherein the motor shaft of the electric motor also acts as the pump shaft.

Figure 4:
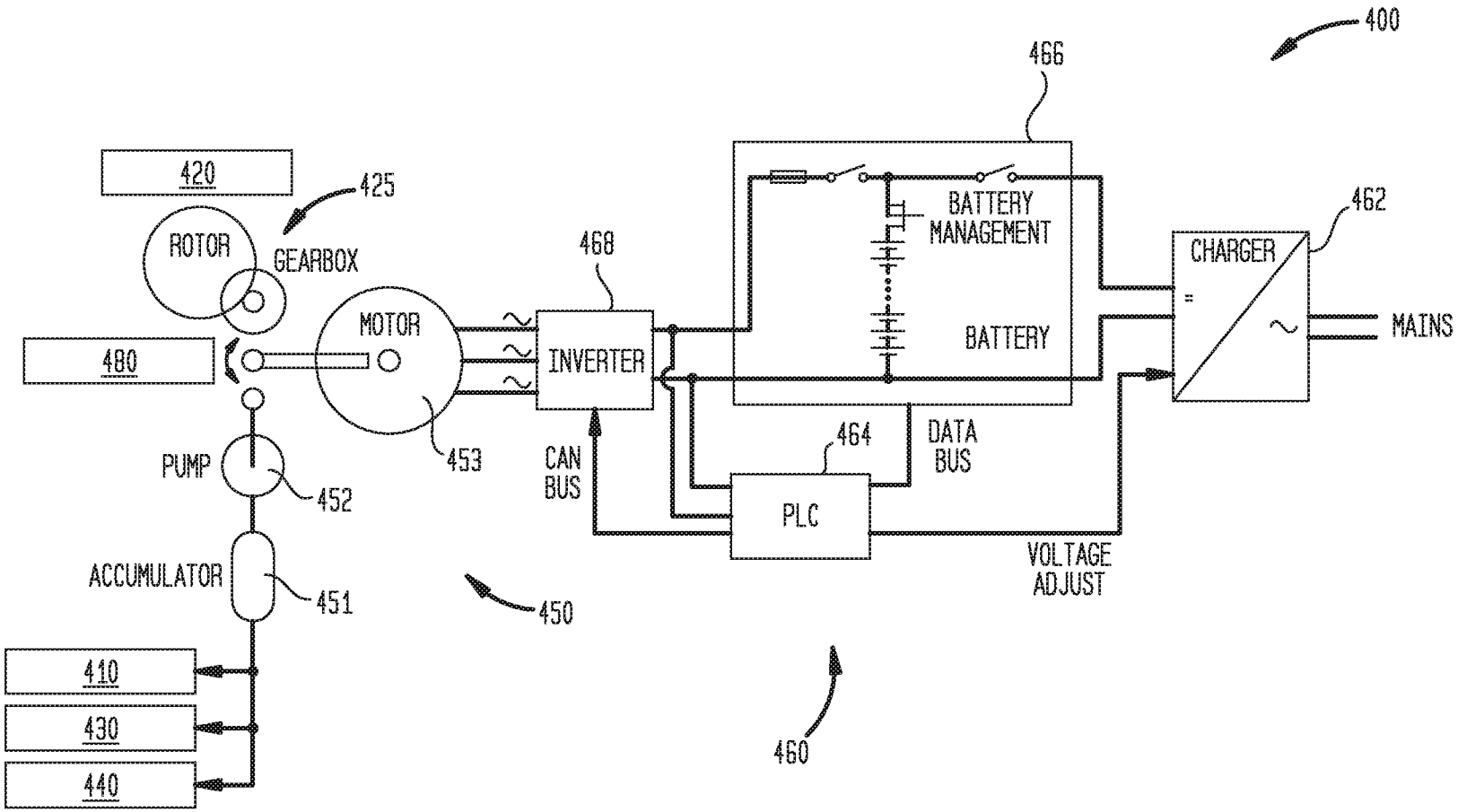
FIG. 4 illustrates a tong system that is configured to switch electric power between a rotary drive configuration and a hydraulic power configuration.

In some embodiments, the hydraulic power unit may be powered by an onboard electric motor. This may allow for a single electric motor to be utilized both for the power tong and for backup tong. For example, a switchbox may decouple the rotor of the power tong when the hydraulic pump is activated. FIG. 4 illustrates a tong system 400 that can switch between a rotary drive configuration and a hydraulic power configuration. As illustrated, tong system 400 includes a hydraulic power unit 450 that includes an accumulator 451 and a pump 452 (which may include a reservoir tank (not shown)). Tong system 400 also includes an onboard electric motor 453. An exemplary onboard electric motor 453 may be a low voltage motor with integrated electronics. Hydraulic power unit 450 may supply hydraulic power to one or more hydraulic power consumers, such as the backup tong 410, the lift actuators 430, and the door actuators 440. Onboard electric motor 453 may also and/or alternatively supply torque and/or rotation to power tong 420. For example, switchbox 480 may switch the output of onboard electric motor 453 between the pump 452 and drivetrain 425 (e.g., a gearbox and a rotor) for power tong 420. In some embodiments, switchbox 480 may be configured to switch the output of onboard electric motor 453 to pump 452 to store hydraulic power in accumulator 451 while one or more of the power tong 420, backup tong 410, lift actuators 430, and/or door actuators 440 are inactive. In some embodiments, switchbox 480 may be configured to switch the output of onboard electric motor 453 to pump 452 to directly drive one or more of the backup tong 410, lift actuators 430, and/or door actuators 440. In some embodiments, tong system 400 may not receive hydraulic power from an external source (e.g., a hydraulic power unit on the rig floor). Specifically, backup tong 410 may only receive hydraulic power from local hydraulic power unit 450.

In some embodiments, onboard electric motor 453 may be selected to supply either (a) sufficient torque and rotation to power tong 420, as illustrated by the work cycle graphs of FIGS. 2-3, or (b) sufficient power to drive hydraulic power unit 450 between power tong work cycles, but not both at the same time, and no more than the maximum of the two. For example a DYNAX 60i motor includes integrated electronics while still being only about 14 kg. Consequently, onboard electric motor 453 may be small enough to not pose excessive risks (e.g., heat, noise, fuel consumption) in the rig environment.

Tong system 400 of FIG. 4 may also include electronics 460. The electronics 460 may include a charger 462, a programmable logic controller 464, a battery 466, and an inverter 468. Electronics 460 and/or inverter 468 may function as a variable frequency drive for onboard electric motor 453. Battery 466 may be a lithium iron phosphate battery and/or a lithium titanate battery. An exemplary battery 466 may be a 14 Ah Prismatic Pouch Cell, available from A123 Systems of Livonia, MI. The battery may be, for example, between about 5 kg to 10 kg. The battery 466 may be contained in a flameproof housing. It is believed that no ATEX standard currently exists for batteries on tong systems, and further testing may be needed. Onboard electric motor 453 may be driven and/or controlled by electronics 460. For example, the torque of onboard electric motor 453 may be proportional to the current coming from the inverter 468. Likewise, the speed of onboard electric motor 453 may be in phase with the frequency of the current coming from the inverter 468. Onboard electric motor 453 may supply torque to power tong 420 in order to make-up to tubulars to a precise target torque while maintaining this torque for some time.

In some embodiments, onboard electric motor 453 and/or electronics 460 may be enclosed in a flameproof housing. For example, the flameproof housing may meet ATEX standards for class 1, zone 1, division 1. In some embodiments, the flameproof housing may be aluminum. In some embodiments, onboard electric motor 453 may be integrated with one or more components of electronics 460.

In some embodiments, programmable logic controller 464 may switch power supply to the consumers. For example, the battery 466 may alternatively charge and discharge, the onboard electric motor 453 may switch between the drivetrain 425 and the hydraulic power unit 450, and the sources of hydraulic power may be the pump 452 and/or the accumulator 451. At times during operations, each of backup tong 410, lift actuators 430, and door actuators 440 may be powered by one or more of the sources of hydraulic power. The programmable logic controller 464 may determine which power source supplies which consumer at any point in time during operations.

Figure 5:
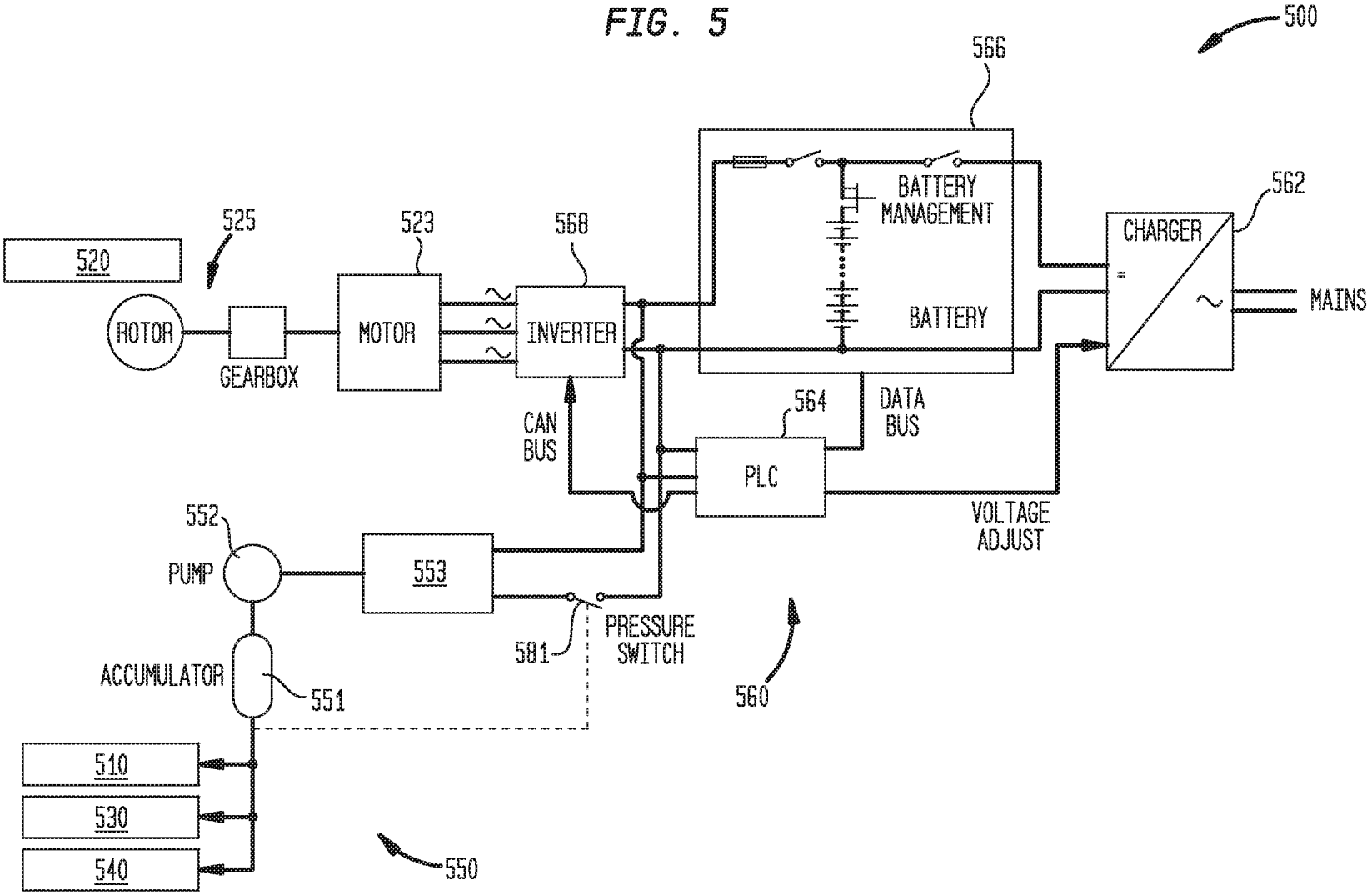
FIG. 5 illustrates a tong system that is configured to provide dedicated electric power to a rotary drive subsystem and a hydraulic power subsystem.

In some embodiments, the hydraulic power unit may be powered by a dedicated onboard electric motor. This may allow for a dedicated electric motor to be utilized for the power tong and a smaller, dedicated electric motor to be utilized for the hydraulic power unit. FIG. 5 illustrates a tong system 500 with separate, dedicated electric motors for the rotary drive configuration and the hydraulic power configuration. As illustrated, tong system 500 includes a hydraulic power unit 550 that includes an accumulator 551 and a pump 552 (which may include a reservoir tank (not shown)). Tong system 500 also includes a first electric motor 523 for the power tong 520, and a second electric motor 553 for the hydraulic power unit 550. The second electric motor 553 may be smaller than the first electric motor 523. In some embodiments, the second electric motor 553 may be about 1/10 of the size of the first electric motor 523. Both the first electric motor 523 and the second electric motor 553 may be otherwise similar to onboard electric motor 453. Hydraulic power unit 550 may supply hydraulic power to one or more hydraulic power consumers, such as the backup tong 510, the lift actuators 530, and the door actuators 540. First electric motor 523 may supply torque and/or rotation to power tong 520. Output of first electric motor 523 may supply power to drivetrain 525 (e.g., a gearbox and a rotor) for power tong 520. In some embodiments, output of second electric motor 553 may supply power to pump 552 to store hydraulic power in accumulator 551 while one or more of the backup tong 510, lift actuators 530, and/or door actuators 540 are inactive. In some embodiments, the output of second electric motor 553 may supply power to pump 552 to directly drive one or more of the backup tong 510, lift actuators 530, and/or door actuators 540. In some embodiments, while the second electric motor 553 and/or the pump 552 are inactive, the accumulator 551 may supply power to directly drive one or more of the backup tong 510, lift actuators 530, and/or door actuators 540. For example, pressure switch 581 may shut off second electric motor 553 when a target pressure in accumulator 551 has been reached. In some embodiments, tong system 500 may not receive hydraulic power from an external source (e.g., a hydraulic power unit on the rig floor). Specifically, backup tong 510 may only receive hydraulic power from local hydraulic power unit 550.

In some embodiments, first electric motor 523 may be selected to supply sufficient torque and rotation to power tong 520, as illustrated by the work cycle graphs of FIGS. 2-3. In some embodiments, second electric motor 553 may be selected to supply sufficient power to drive hydraulic power unit 550 between power tong work cycles. Consequently, first electric motor 523 and/or second electric motor 553 may be small enough to not pose excessive risks (e.g., heat, noise, fuel consumption) in the rig environment.

Tong system 500 of FIG. 5 may also include electronics 560. The electronics 560 may include a charger 562, a programmable logic controller 564, a battery 566, and an inverter 568. Electronics 560 may be configured similar to electronics 460 and may function similar thereto. First electric motor 523 may be driven and/or controlled by electronics 560. For example, the torque of first electric motor 523 may be proportional to the current coming from the inverter 568. Likewise, the speed of first electric motor 523 may be in phase with the frequency of the current coming from the inverter 568. First electric motor 523 may supply torque to power tong 520 in order to make-up to tubulars to a precise target torque while maintaining this torque for some time.

Second electric motor 553 may be controlled by electronics 560. In some embodiments, programmable logic controller 564 may control power supply to the consumers. For example, the sources of hydraulic power may be the pump 552 (driven by the second electric motor 553) and/or the accumulator 551. At times during operations, each of backup tong 510, lift actuators 530, and door actuators 540 may be powered by one or more of the sources of hydraulic power. The programmable logic controller 564 may determine which power source supplies which consumer at any point in time during operations. For example, the programmable logic controller 564 may determine a target pressure for accumulator 551. Pressure switch 581 may shut off second electric motor 553 when the target pressure in accumulator 551 has been reached.

Figure 6:
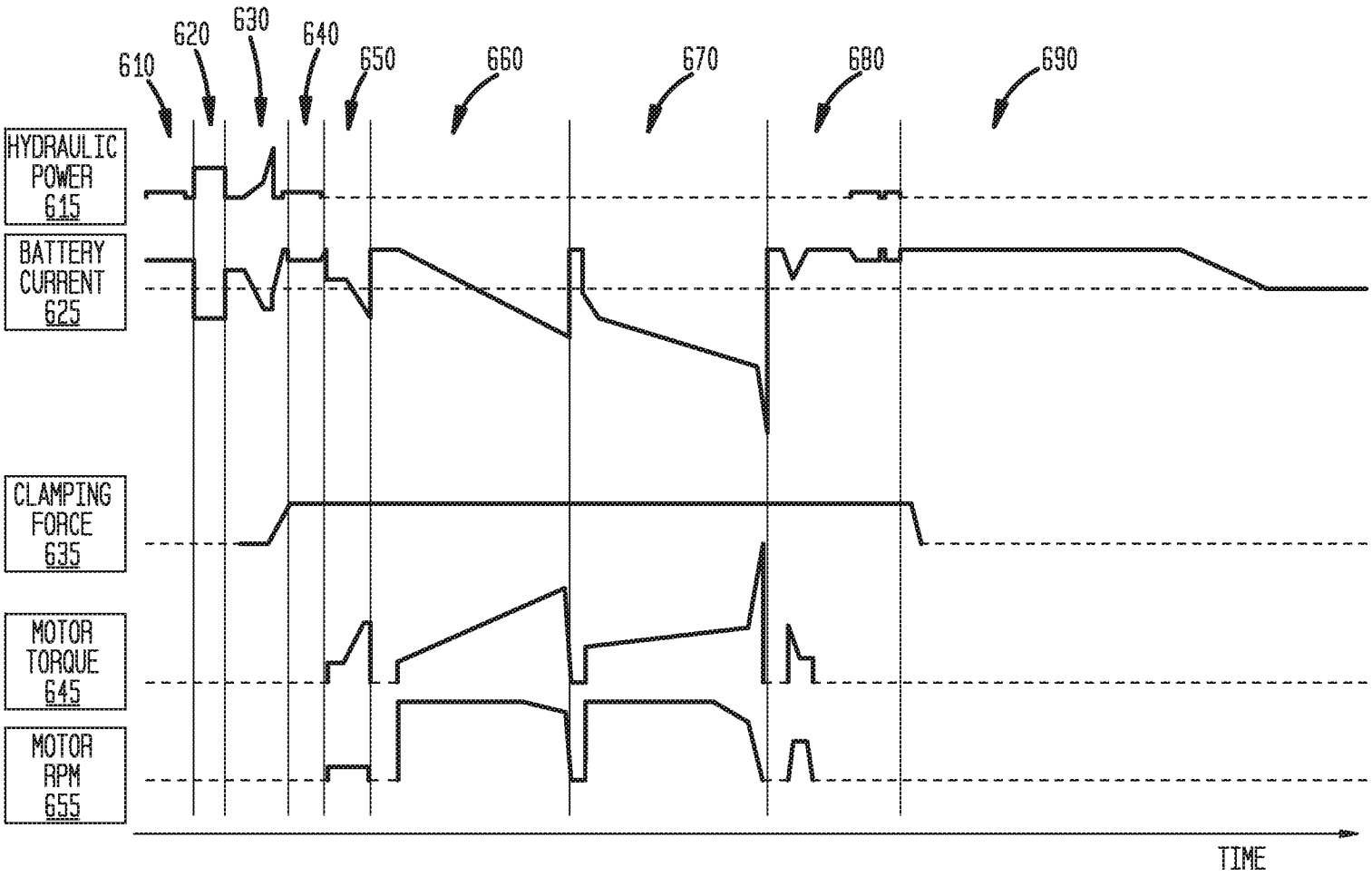
FIG. 6 illustrates an exemplary make-up cycle for a tong system with local hydraulic power generation.

An exemplary make-up cycle 600 is illustrated in FIG. 6. The illustrated make-up cycle 600 is applicable to tong system 400, and a similar make-up cycle could be envisioned for tong system 500. Initially, in region 610, hydraulic power is supplied to the door actuator 440 to open the tubular access door 145 and allow for stabbing-in of new tubular. Accumulator 451 and/or pump 452 may supply hydraulic power to door actuator 440. Switchbox 480 may, therefore, be set to power hydraulic power unit 450 with onboard electric motor 453 during this initial region 610. The amount of hydraulic power 615 supplied is relatively low, so the battery 466 may charge (positive current 625) during region 610. In region 620, lift actuators 430 may vertically position the backup tong 410. Accumulator 451 and/or pump 452 may supply hydraulic power to lift actuators 430, and switchbox 480 may remain set to power hydraulic power unit 450 with onboard electric motor 453 during region 620. The amount of hydraulic power 615 supplied is sufficiently high to cause battery 466 to discharge (negative current 625). In region 630, backup tong 410 may clamp the tubular. Accumulator 451 and/or pump 452 may supply hydraulic power to backup tong 410, and switchbox 480 may remain set to power hydraulic power unit 450 with onboard electric motor 453 during region 630. As backup tong 410 engages and securely clamps the tubular, the hydraulic power 615 increases, causing the battery 466 to cycle from charging to discharging (positive to negative current 625). Clamping force 635 is initially constant during region 630, increasing to the endpoint for backup tong 410 at the end of region 630. In region 640, door actuator 440 may close the tubular access door 145 as backup tong 410 continues to securely clamp the tubular. Accumulator 451 and/or pump 452 may supply hydraulic power to door actuators 440 and backup tong 410, and switchbox 480 may remain set to power hydraulic power unit 450 with onboard electric motor 453 during region 640. The clamping force 635 is essentially constant during region 640. Throughout regions 610-640, onboard electric motor 453 has zero torque 645 and rotation speed 655.

The exemplary make-up cycle 600 continues from region 640 to region 650 wherein switchbox 480 switches the onboard electric motor 453 from supplying power to the hydraulic power unit 450 to the drivetrain 425 of power tong 420. Hydraulic power 615 from onboard electric motor 453, therefore, remains at zero in region 650 through the middle of region 680. The relatively constant clamping force 635 of backup tong 410 may be maintained by the accumulator 451. In some embodiments, a brace may be applied to hold the backup tong 410 in the clamped position, thereby maintaining the relatively constant clamping force 635 without hydraulic power from the accumulator 451 or pump 452. In some embodiments, a valve may be closed to hold pressure in the cylinder(s) of backup tong 410, thereby maintaining the relatively constant clamping force 635 without hydraulic power (pressure or flow) from the accumulator 451 or pump 452.

In region 650, onboard electric motor 453 initially drives drivetrain 425 with low torque 645 and low rotation speed 655 as tubular threading is engaged. Torque 645 may be increased as threading is confirmed. Current 625 may cause the battery 466 to go from charging to discharging as torque 645 increases. In region 660, onboard electric motor 453 may operate drivetrain 425 in high gear to spin-in the tubular. The onboard electric motor 453 may initially have zero torque 645 and rotation speed 655 while shifting gears. Current 625 may initially charge battery 466 until higher torques 645 cause the battery to discharge. The spin-in of region 660 may continue at a relatively constant rotation speed 655 until a reference torque 645 is reached. In region 670, onboard electric motor 453 may operate drivetrain 425 in low gear to make-up the connection to a target torque 645. By shifting gears, the rotation speed 655 of onboard electric motor 453 in region 670 may be similar to that of region 660. The ongoing clamping force 635, rotation speed 655, and increasing torque 645 causes the current 625 to be negative (battery 466 discharging) during much of region 670.

The exemplary make-up cycle 600 concludes in regions 680 and 690, as the threaded connection now couples the tubular to the tubular string. Power tong 420 is detached from the tubular early in region 680, requiring a relatively small amount of torque 645 and rotation speed 655 from onboard electric motor 453. Switchbox 480 then switches the onboard electric motor 453 to the hydraulic power unit 450. The door actuators 440 may open the tubular access door 145 to release the tubular, drawing a relatively low amount of hydraulic power 615. Battery 466 may charge with positive current 625 during region 680. Lastly, in region 690, backup tong 410 releases the tubular. As clamping force 635 ceases, current 625 may charge the battery 466 until it is fully charged.

In an embodiment a tong system includes a power tong for spinning tubulars; a first electric motor functionally connected to the power tong; a plurality of hydraulic power consumers including a backup tong for clamping a tubular string; a second electric motor functionally connected to the plurality of hydraulic power consumers; and electronics to drive the first electric motor and the second electric motor.

In one or more embodiments disclosed herein, the plurality of hydraulic power consumers comprises at least one of a lift actuator and a door actuator.

In one or more embodiments disclosed herein, the first electric motor couples to the power tong through a drivetrain having a low gear and a high gear.

In one or more embodiments disclosed herein, the tong system also includes a pump and an accumulator, wherein the second electric motor supplies hydraulic power with the pump.

In one or more embodiments disclosed herein, the tong system also includes a pressure switch to determine whether the pump or the accumulator supplies hydraulic power to at least one of the plurality of hydraulic power consumers.

In one or more embodiments disclosed herein, at least one of a torque and a speed of the first electric motor is controlled by the electronics.

In one or more embodiments disclosed herein, the electronics comprise a battery that is capable of charging while the first electric motor and the second electric motor together draw low current and discharging while the first electric motor and the second electric motor together draw high current.

In one or more embodiments disclosed herein, the electronics includes a charger; a programmable logic controller; a battery; and an inverter.

In an embodiment, a tong system includes a power tong for spinning tubulars; a plurality of hydraulic power consumers including a backup tong for clamping a tubular string; an onboard electric motor; and a switchbox providing at least two configurations of the tong system: in a first configuration, the onboard electric motor drives the power tong but does not supply hydraulic power to the plurality of hydraulic power consumers; and in a second configuration, the onboard electric motor does not drive the power tong but does supply hydraulic power to at least one of the plurality of hydraulic power consumers.

In one or more embodiments disclosed herein, the plurality of hydraulic power consumers comprises at least one of a lift actuator and a door actuator.

In one or more embodiments disclosed herein, in the first configuration, the onboard electric motor couples to the power tong through a drivetrain having a low gear and a high gear.

In one or more embodiments disclosed herein, the tong system also includes a pump and an accumulator, wherein, in the second configuration, the onboard electric motor supplies hydraulic power with the pump.

In one or more embodiments disclosed herein, in the first configuration, the accumulator supplies hydraulic power to at least one of the plurality of hydraulic power consumers.

In one or more embodiments disclosed herein, the tong system also includes electronics, wherein, in the first configuration, at least one of a torque and a speed of the onboard electric motor is controlled by the electronics.

In one or more embodiments disclosed herein, the electronics comprise a battery that is capable of charging while the onboard electric motor draws low current and discharging while the onboard electric motor draws high current.

In one or more embodiments disclosed herein, the electronics include a charger; a programmable logic controller; a battery; and an inverter.

In an embodiment, a tong system includes a backup tong for clamping a tubular string; an onboard electric motor; and an onboard hydraulic power unit coupled to the onboard electric motor to supply hydraulic power to the backup tong.

In one or more embodiments disclosed herein, the hydraulic power unit comprises a pump and an accumulator.

In one or more embodiments disclosed herein, the tong system also includes a pressure switch to determine whether the pump or the accumulator supplies hydraulic power to the backup tong.

In one or more embodiments disclosed herein, a volume of the hydraulic power unit is less than about 50 liters.

In an embodiment, a method of making-up tubulars includes arranging a tong system in a hydraulic power configuration; supplying hydraulic power to at least one of a plurality of hydraulic power consumers to position a tubular for make-up; arranging the tong system in a rotary drive configuration; supplying at least one of torque and rotation to a power tong; wherein an onboard electric motor of the tong system supplies the hydraulic power when the tong system is in the hydraulic power configuration, and the onboard electric motor supplies the at least one of torque and rotation when the tong system is in the rotary drive configuration.

In one or more embodiments disclosed herein, the onboard electric motor does not supply hydraulic power when the tong system is in the rotary drive configuration, and the onboard electric motor does not supply torque or rotation when the tong system is in the hydraulic power configuration.

In one or more embodiments disclosed herein, the plurality of hydraulic power consumers comprises a door actuator, and positioning the tubular for make-up includes opening a tubular access door with the door actuator.

In one or more embodiments disclosed herein, the plurality of hydraulic power consumers comprises a lift actuator and a backup tong, and positioning the tubular for make-up includes vertically positioning the backup tong with the lift actuator.

In one or more embodiments disclosed herein, the plurality of hydraulic power consumers comprises a backup tong, the method further comprising clamping a tubular string with the backup tong.

In one or more embodiments disclosed herein, the onboard electric motor supplies hydraulic power to the backup tong when the tong system is in the hydraulic power configuration, and an accumulator of the tong system supplies hydraulic power to the backup tong when the tong system is in the rotary drive configuration.

In one or more embodiments disclosed herein, the tong system comprises electronics, the method further comprising controlling at least one of a torque and a speed of the onboard electric motor with the electronics.

In one or more embodiments disclosed herein, the electronics comprises a battery, the method further comprising charging and discharging the battery in response to current drawn by the onboard electric motor.

In one or more embodiments disclosed herein, the supplying at least one of torque and rotation to the power tong comprises first spinning the tubular in high gear until a reference torque is reached, and then spinning the tubular in low gear to a target torque.

While the foregoing is directed to embodiments of the present invention, other and further embodiments of the invention may be devised without departing from the basic scope thereof, and the scope thereof is determined by the claims that follow.

The invention claimed is:

1. A tong system comprising:

a power tong for rotating a first tubular;

a plurality of hydraulic power consumers including a backup tong for clamping a second tubular;

an onboard electric motor; and a switchbox providing at least two configurations of the tong system:

in a first configuration, the onboard electric motor mechanically drives the power tong but does not supply hydraulic power to the plurality of hydraulic power consumers; and in a second configuration, the onboard electric motor does not mechanically drive the power tong but does supply hydraulic power to at least one of the plurality of hydraulic power consumers.

2. The tong system of claim 1, wherein the plurality of hydraulic power consumers comprises at least one of a lift actuator and a door actuator.

3. The tong system of claim 1, wherein, in the first configuration, the onboard electric motor couples to the power tong through a drivetrain having a low gear and a high gear.

4. The tong system of claim 1, further comprising a pump and an accumulator, wherein, in the second configuration, the onboard electric motor supplies hydraulic power with the pump.

5. The tong system of claim 4, wherein, in the first configuration, the accumulator supplies hydraulic power to at least one of the plurality of hydraulic power consumers.

6. The tong system of claim 1, further comprising electronics, wherein, in the first configuration, at least one of a torque and a speed of the onboard electric motor is controlled by the electronics.

7. The tong system of claim 6, wherein the electronics comprise a battery that is capable of charging while the onboard electric motor draws low current and discharging while the onboard electric motor draws high current.

8. The tong system of claim 6, wherein the electronics comprise:

a charger;

a programmable logic controller;

a battery; and an inverter.

9. A tong system comprising:

a power tong for rotating a first tubular;

a backup tong for clamping a second tubular;

an onboard electric motor; and a switchbox adapted to switch between at least two configurations of the tong system:

in a first configuration, the onboard electric motor is mechanically coupled to a drivetrain of the power tong and is mechanically decoupled from an onboard hydraulic power unit, and in a second configuration, the onboard electric motor is mechanically coupled to the onboard hydraulic power unit and is mechanically decoupled from the drivetrain of the power tong.

10. The tong system of claim 9, wherein the hydraulic power unit comprises a pump and an accumulator.

11. The tong system of claim 10, further comprising a pressure switch to determine whether the pump or the accumulator supplies hydraulic power to the backup tong.

12. The tong system of claim 11, wherein the pressure switch is configured to shut off the onboard electric motor when a predetermined pressure is reached in the accumulator.

13. The tong system of claim 9, wherein a volume of the hydraulic power unit is less than about 50 liters.

* * * * *